United States Patent [19]

Brewer

[11] 4,176,800

[45] Dec. 4, 1979

[54] MATERIALS REDUCTION STRUCTURE

[75] Inventor: John C. Brewer, Salt Lake City, Utah

[73] Assignee: Garbalizer Corporation of America, Salt Lake City, Utah

[21] Appl. No.: 868,662

[22] Filed: Jan. 11, 1978

[51] Int. Cl.[2] ..... B02C 18/06

[52] U.S. Cl. ..... 241/243; 144/172; 241/294

[58] Field of Search ..... 241/190, 224, 243, 294, 241/185 R, 186 R, 189 R, 220, 221, 222, 226, 277, 280, 301; 144/172

[56] References Cited

U.S. PATENT DOCUMENTS

| | | | |
|---|---|---|---|
| 1,980,952 | 11/1934 | Fegley et al. | 241/243 X |
| 2,065,677 | 12/1936 | Fegley et al. | 241/221 X |
| 2,068,450 | 1/1937 | Eberly | 241/243 |
| 2,195,363 | 3/1940 | Fegley et al. | 241/243 X |
| 2,853,247 | 9/1958 | Anderson | 241/190 |
| 2,863,476 | 12/1958 | Clark | 144/172 |
| 2,986,347 | 5/1961 | Stevenson | 241/294 |
| 3,224,688 | 12/1965 | Beiter | 241/189 R X |
| 3,545,686 | 12/1970 | Brown | 241/243 X |
| 3,801,027 | 4/1974 | Kubitz | 241/294 X |
| 3,823,633 | 7/1974 | Ross | 241/294 X |
| 3,893,635 | 7/1975 | Brewer | 241/243 |
| 4,000,860 | 1/1977 | Gotham | 241/294 X |
| 4,015,782 | 4/1977 | Granite | 241/243 X |
| 4,059,236 | 11/1977 | Brewer | 241/243 |

*Primary Examiner*—Othell M. Simpson
*Assistant Examiner*—Robert P. Olszewski

[57] ABSTRACT

Reduction structure including a revolving rotor and stationary structure. The revolving rotor is notched to provide a series of cutter sockets that individually receive cutters, preferably hardened steel cutters. The cutters are arranged in their sockets such that a majority of the length thereof is disposed within each socket; thereby, bolt attachment means may be reduced in number and can conceivably be one in number per cutter. The ends of the shaft are preferably turned down for bearing support and coupling to adjacent prime mover structure. The hopper, within which the rotor as above-described is mounted, preferably includes an anti-rotation member in the form of an elongate bar having one or more declining flanges, these flanges serving to preclude counter-rotation of any element such as logs as may be introduced into such hopper. For reduction such as shearing in connection with automobile and truck tires, the clearances around the individual cutters as the same pass through notches within the stationary cutter bar employed should be reduced to not more than 1/8th of the cutter width; by this restriction the cords in tires are sharply cut and do not string out from cut segments so as to foul materials-handling machinery, screens, and so forth, as may subsequently be used.

6 Claims, 6 Drawing Figures

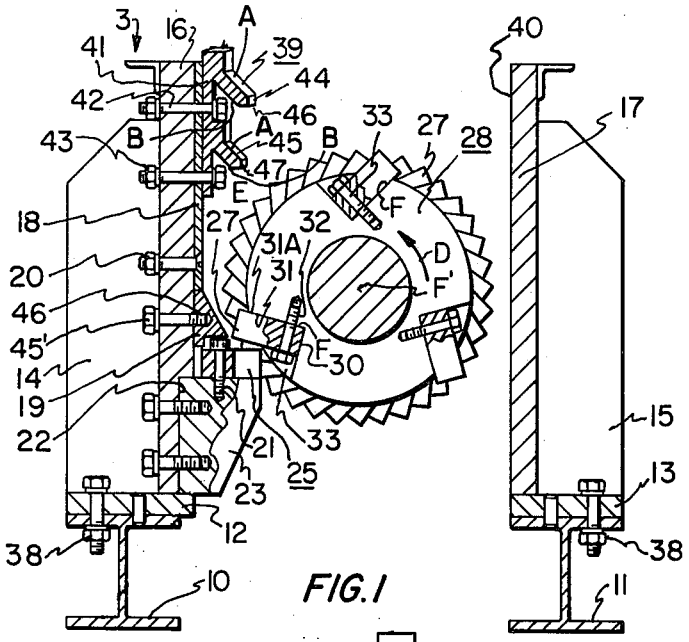
FIG. 1
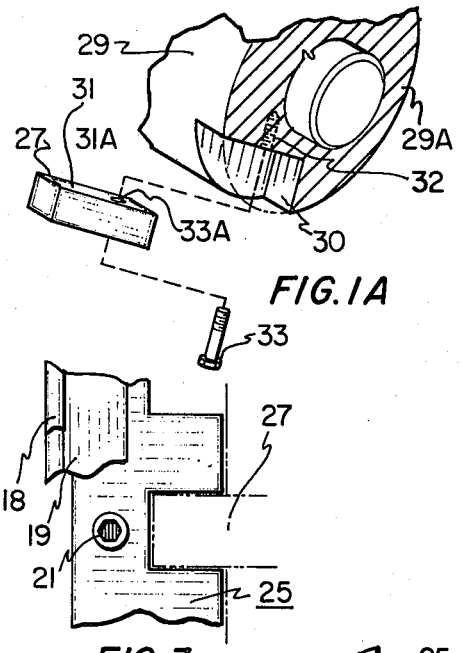
FIG. 1A
FIG. 3
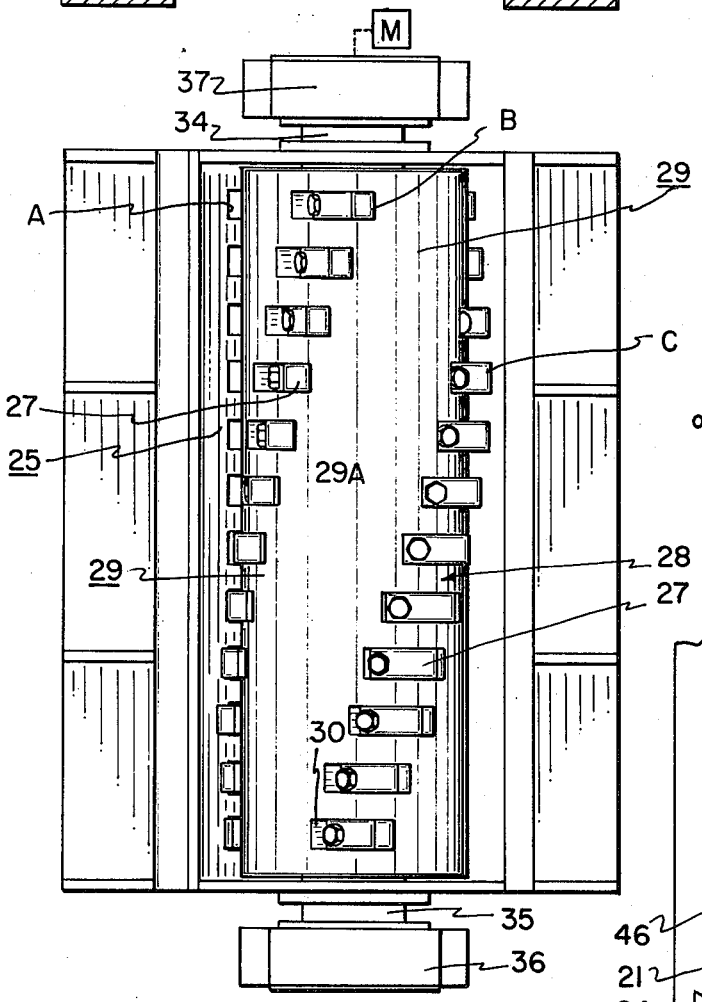
FIG. 2
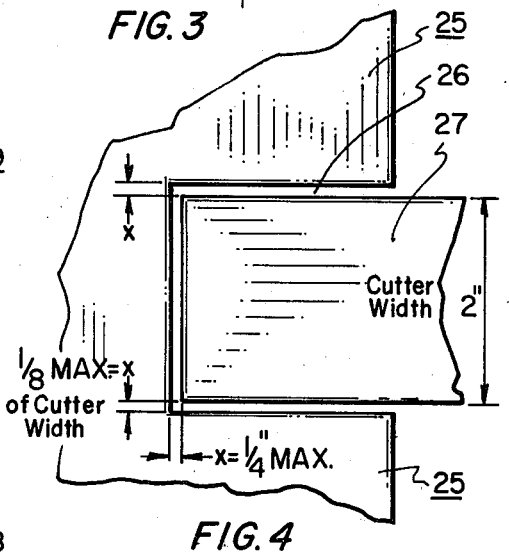
FIG. 4
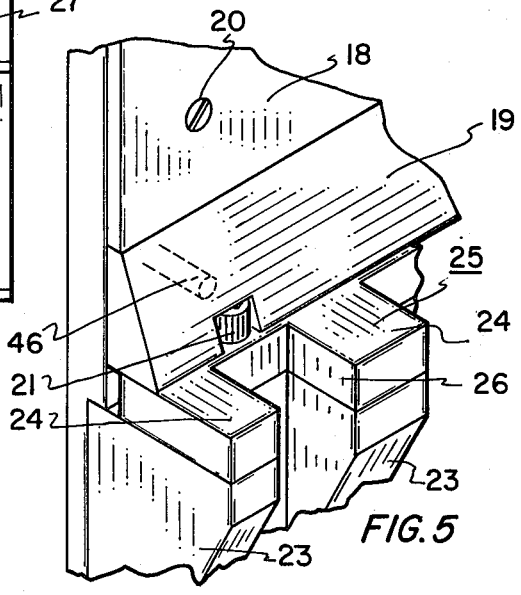
FIG. 5

MATERIALS REDUCTION STRUCTURE

FIELD OF INVENTION

The present invention relates to materials' reduction machinery and, more particularly, the machinery of the type described having an improved and simplified rotor provided with a series of cutters, and also hopper structure including an anti-rotation member, this for precluding the counter-rotation of materials as may be introduced into the hopper proximate the cutting area of the rotor.

DESCRIPTION OF PRIOR ART

Certain United States patents are known which bear upon the subject of reduction structure as such. These are as follows:

U.S. Pat. Nos. 3,545,686; 3,762,256; 2,842,175; 3,578,252; 3,874,604; 3,708,127; 2,841,341; 3,762,655; 3,202,369; 3,840,187; 3,931,935; 1,444,035.

None of the above patents teach the important concepts, residing in the present invention, of including an anti-rotation member within a hopper so as to preclude lumber, logs and other materials from counter-rotating as the rotor is revolved to perform its intended cutting or shearing function. Likewise, prior art teaches the concept of oppositely extending blades for rotors whereas, in the present instance, hardened steel cutter segments are simply seated in convenient rotor slots and bolted in place by single bolts. A majority of the length of each cutter is disposed within its respective slot such that loading is taken up by a rotor surface and not by the attaching bolt head, or at least less so. Thus, smaller bolts can be employed for securing the cutters to the rotor, and this without destroying the load-carrying characteristics of the rotor when the same is in cutting operation. Finally, in none of the art is there taught a restriction in tolerance spacing as between the cutters and the notches of the cutter bar, held stationary, whereby the cords and other reinforcing material of tires and other materials can be sharply cut so as to avoid their stringing out from severed pieces and fouling materials' handling equipment such as sieves and screens that may subsequently be used. In this invention there is a restriction as to tolerance for certain types of machines where the cutting of tires and other reinforced materials is in prospect.

BRIEF DESCRIPTION OF THE INVENTION

According to the present invention a rotor is provided having an enlarged central portion with turned-down ends. The enlarged central portion includes a series of notches or cutter sockets that are preferably mutually spaced along mutually-spaced helicies such that only one cutter element will approach its cutting position relative to the stationary cutter bar used at any one particular time. The cutter sockets are appreciable in length relative to the cutter dimension such that a majority of the cutter length is disposed proximate the load surface of the shaft cutter socket, this so that a majority of the load is taken up by the revolving shaft and not by the bolt means that secures the cutter in its socket within the shaft. The ends of the cutters, of course, protrude outward slightly so that cutting edges are provided to cut or shear incoming materials. Cutter bar slots are restricted. A removable anti-rotation member in the form of a horizontal bar,generally, is included to deter anti-rotation of wood materials introduced within the hopper of the materials reduction machinery. The anti-rotation member, removed when, e.g., wood is not involved, preferably includes one or more inwardly oriented declining flanges, the same preferably being pointed and thereby constituting means for impinging upon incoming material and deterring the same from rotating to disadvantage when the rotor is in operation.

OBJECTS

Accordingly, a principal object of the present invention is to provide new and improved materials' reduction machinery.

A further object is to provide an improved rotor in materials' reduction machinery.

A further object is to provide in a rotor construction a shaft having a series of notches or sockets, these being provided for the reception of cutter elements that can be bolted or otherwise secured in place to provide cutting means for the rotor.

An additional object is to provide in a rotor for materials' reduction machinery a series of cutters disposed within sockets in a shaft, and this such that a majority of the shearing or cutting loading is imposed upon the rotor itself rather than upon any cutter attachment means employed.

An additional object is to provide improved shredding or shearing apparatus.

A further object is to provide anti-rotation means in materials reduction equipment.

An additional object is to provide shearing structure wherein tolerances fall within a predetermined maximum so that shearing of reinforced materials is made possible.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

IN THE DRAWINGS

FIG. 1 is a side elevation of materials' reduction machinery constructed in accordance with the present invention.

FIG. 1A is a fragmentary perspective detail of a portion of the rotor in such materials' reduction machinery in FIG. 1, wherein a respective cutter or cutter element is exploded from its socket within the rotor, to show the construction of both.

FIG. 2 is a plan view of the structure shown in FIG. 1.

FIG. 3 is a fragmentary plan view taken along the arrow 3 in FIG. 1.

FIG. 4 is an enlarged fragmentary plan similar to FIG. 3, illustrating one recess of the stationary cutter bar employed, wherein this representative recess enjoys a highly restricted clearance as between its edges and a respective cutter employed, this for insuring optimum shearing of cords and webs in reinforced materials introduced into the shredder.

FIG. 5 is a fragmentary, enlarged perspective of the hopper interior indicating the slots or recesses of the stationary cutter bar used which receives, at such slots, the cutters employed in the rotor of the machine.

DETAILED DESCRIPTION OF PREFERRED EMBODIMENT

In FIGS. 1 and 2 horizontal I beam supports 10 and 11 are fixed structure and support respected plates 12 and 13. Upstanding from these plates are respective series of side ribs 14 and 15, the series supporting upstanding side plates 16 and 17 end views of which are shown in FIG. 1. To side plate 16 is secured a liner 18 and also a ramp 19 of triangular cross section. Securement of these parts is made by bolts 20 and 45', by way of example. Side plate 16 is horizontally notched or recessed at 22 to provide for the incorporation of respective support blocks 23 that underlie each of the projections 24, see FIG. 5, of stationary cutter bar 25. Attachments 21 secure cutter bar 25 to the structure at 23. The projections, see again FIG. 5, are separated by spacings 26 that receive the respective cutters 27 of the rotor 28. Rotor 28 comprises a shaft 29 and a series of cutters 27 respectively seated in seatlike recesses or sockets 30. These cutter sockets or four-sided pockets fit the inner periphery 31 of each cutter, see FIG. 1, and are respectively provided with bored apertures 32 for receiving bolt attachments 33. This construction is typical for all of the cutters used. Preferably, the cutters will be arranged in three sets, A, B and C, see FIG. 2, each set being helically arranged about the shaft 29. The cutters will be so spaced such that only one cutter will initially approach a slot or recess 26 in stationary cutter bar 25 at any one given time. This is so that the entire force of the machine may be imposed on any particular piece being cut at any particular time.

Shaft 29 includes enlarged central shaft portion 29A and also turned-down ends 34 and 35 which seat in respective bearings 36 and 37. These bearings may be supported by any conventional fixed structure, now shown, which is fixedly disposed relative to I beam supports 10 and 11. Such fixed structure, per se, forms no part of the present invention.

Shaft 29 is keyed to a prime mover such as induction motor M in FIG. 2. Suitable clutching may be employed as desired, as between the motor M and shaft 29. Bolt attachments 38 may secure the plates 12 and 13 to the I beam supports 10 and 11. The ribs 14 and 15 may be welded in place or otherwise secured as in the case of the inventor's U.S. Pat. No. 4,099,678.

Of special importance is the inclusion of an anti-rotation member 39, the same being shown in fragmentary perspective view in FIG. 1. This rotation bar is preferably unitary and disposed horizontally in the inside of hopper 40 of the equipment. The anti-rotation member includes a base 41 that is secured to the side plate 16 by means of bolt and nut attachments 42 and 43, these provided with suitable apertures for accommodating such attachment. The bar member 39 has a series of downwardly angulated flanges 44 and 45 which may be pointed or include respective horizontal sharpened edges 46 and 47. In operation, the anti-rotation member tends to preclude wood members such as logs from rotating in a clockwise direction as shown by the arrow D. Accordingly, the several cutters 27 will be disposed, by virtue of the essential holding or retarding action of flanges 44 and 45 of member 39, to cut into the member being cut or sheared or notched without the cutter simply serving to rotate the wood log or other member about its axis once it is disposed proximate the area E of the unit.

In general operation as the rotor relative to the fixed structure, the series of cutters or cutter elements 27 move progressively about the axis F' of the rotor 28 so as to descend into slots 26 of the stationary cutter bar 25 in FIG. 5. Should one of the cutters become damaged or need relacement, it is a simple matter for the operator to stop the machine and then to loosen the bolt holding the cutter in place. It is noted that the primary length of the cutter is disposed within the notch or cutter seat of the shaft. Accordingly, forces in shear are taken along the boundary F of each seat so that essentially no counterforce is applied the underside of a respective bolt 33. Essentially, no load, or little load is supplied bolt 33 in cutter hole 33A; rather, the entire force of the cut is taken up by the shaft proximate the boundary F in FIG. 1.

For items such as tires which are to be cut, it is proper that the clearance between a respective cutter and its slot 26 be restricted. For two-inch wide cutters this restriction should be $\frac{1}{4}$ of an inch or less as is shown by the dimension X in FIG. 4. Where this dimension is larger than $\frac{1}{4}$ inches, then, because tires and the like contain steel, nylon, or other cords, such cords must be sheared or cut immediately proximate and preferably at the cut by the cutter produced in the tire. Where clearance is larger than $\frac{1}{4}$ inches where two-inch wide cutters are involved, then the piece tends to be dragged along the intended shearing edges and the tire is pulled such that the cord actually is not severed properly. The stringy cord-remains attached to cut pieces then tend to foul in materials' handling machinery such as screens. Such is not the case where, as here, the cutters pass through the notches or recesses, respectively, of the stationary cutter bar in a manner such that the clearance is restricted to $\frac{1}{8}$th of cutter width. Preferably, even closer tolerances are maintained, and can be maintained by techniques explained in the inventor's U.S. Pat. No. 4,082,232 which is fully incorporated herein by way of reference. This is where the rotor is fixed against axial translation or displacement in the manner described by the inventor's patent immediately above referenced.

Where the stationary cutter bar is to be replaced periodically, then the ramp can be removed by loosening bolts 45' threaded into the ramp at 46'.

Thus, several features in the present invention constitute important improvements in the art. The anti-rotation member 39, generally a horizontally elongate member, has the means necessary, in the provision of flanges 44 and 45, having opposite declining parallel surfaces A and B, so as to preclude the inadvertent counter-rotation of lumber dropped into the hopper 40. The same permits the cutters of rotor 28 to "bite" into the log and otherwise satisfactorily reduce the same so that the chips fall downwardly as intended.

It is further important to note that the cutters may comprise hardened steel elements and, in being disposed in their respective cutter sockets 30 in the shaft, will preclude the necessity of using bushings, collars and blade supports at these points. It is important to note that these cutters are sufficiently exposed within the cutter seats such that only a minor portion of the cutter extends beyond the periphery of the shaft, the major portion at 31 in FIG. 1 abutting that seat surface at 31A so that an excess of 85% of the load, for example, is taken up by the shaft. Thus, there is essentially no load intention applied to the bolt 33 and hence only a single bolt need be employed for each cutter securement.

Conceivably more bolts can be employed for each cutter; however, this is deemed unnecessary. Furthermore, the flanges may be serrated or there may be simply a single flange provided for the anti-rotation elongate bar at 39. For true shearing actions, the clearance between the cutters or cutting elements and the cutter bar slot surfaces should be no more than ⅛th the width of the cutter at each side and end of the cutter as the same passes through its respective stationary cutter bar slot 26, see FIG. 4.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. In materials' reduction machinery having an hopper, a stationary cutter bar proximate said hopper, and a horizontally journalled, revolvable rotor provided with cutting blades and disposed proximate said cutter bar: an improvement comprising a horizontal, materials' anti-revolvement member, secured to said hopper essentially above said cutter bar and having declining flange means provided with opposite declining parallel surfaces, and longitudinally, continuously, and uniformly spaced, for materials' passage, from said rotor and said blades for all orientations thereof, whereby to wedge and thereby tend to prevent rotation of materials in said hopper proximate said rotor and tending to pass between said member and said rotor such that said rotor is enabled to cut into said materials.

2. The structure of claim 1 wherein said member comprises a horizontal elongate bar fixedly disposed with respect to said hopper and having a projecting, materials' abutment.

3. The structure of claim 1 wherein said member has at least one, downwardly and inwardly projecting, materials' contact flange.

4. In combination, a revolvable cutter-type bladed rotor, a stationary reaction cutter bar, and declining flange means provided with opposite declining parallel surfaces and disposed above said reaction bar and continuously, horizontally, and uniformly spaced from said rotor for materials' passage between said rotor and said means, for wedging and thereby tending to prevent materials' rotation whereby said bladed rotor may progressively reduce said materials such that the same may fall proximate said reaction bar for further reduction by said bladed rotor.

5. The structure of claim 4 wherein said means comprises a stationary, inwardly directed projection for contacting incoming materials.

6. The structure of claim 4 wherein said means comprises a horizontal bar having a downwardly and inwardly projecting protrusion.

* * * * *